US006710134B2

(12) United States Patent
Demain

(10) Patent No.: US 6,710,134 B2
(45) Date of Patent: Mar. 23, 2004

(54) POLYPROPYLENE FIBRES

(75) Inventor: Axel Demain, Tourinnes-Saint-Lambert (BE)

(73) Assignee: Atofina Research, Feluy (BE)

( * ) Notice: Subject to any disclaimer, the term of this patent is extended or adjusted under 35 U.S.C. 154(b) by 0 days.

(21) Appl. No.: 10/204,144

(22) PCT Filed: Feb. 19, 2001

(86) PCT No.: PCT/EP01/01934

§ 371 (c)(1),
(2), (4) Date: Oct. 30, 2002

(87) PCT Pub. No.: WO01/61084

PCT Pub. Date: Aug. 23, 2001

(65) Prior Publication Data

US 2003/0118818 A1 Jun. 26, 2003

(30) Foreign Application Priority Data

Feb. 18, 2000 (EP) ..... 00200552

(51) Int. Cl.[7] ..... C08L 23/12; D02G 3/02; D04H 3/00

(52) U.S. Cl. ..... 525/240; 428/364; 428/373; 428/365; 442/361

(58) Field of Search ..... 428/364, 373; 442/361; 525/240; 526/113, 114, 115, 116, 117, 118, 119

(56) References Cited

FOREIGN PATENT DOCUMENTS

WO WO 97/10300 * 3/1997

* cited by examiner

*Primary Examiner*—Roberto Rabago
(74) *Attorney, Agent, or Firm*—William D. Jackson

(57) ABSTRACT

A polypropylene fibre including at least 80% by weight of a first isotactic polypropylene produced by a metallocene catalyst, and from 5 to 20 by weight of a second isotactic polypropylene produced by a Ziegler-Natta catalyst.

14 Claims, 3 Drawing Sheets

POLYPROPYLENE FIBRES

The present invention relates to polypropylene fibres and to fabrics produced from polypropylene fibres.

Polypropylene is well known for the manufacture of fibres, particularly for manufacturing non-woven fabrics.

EP-A-0789096 and its corresponding WO-A-97/29225 discloses such polypropylene fibres which are made of a blend of syndiotactic polypropylene (sPP) and isotactic polypropylene (iPP). That specification discloses that by blending from 0.3 to 3% by weight of sPP, based on the total polypropylene, to form a blend of iPP-sPP, the fibres have increased natural bulk and smoothness, and non-woven fabrics produced from the fibres have an improved softness. Moreover, that specification discloses that such a blend lowers the thermal bonding temperature of the fibres. Thermal bonding is employed to produce the non-woven fabrics from the polypropylene fibres. The specification discloses that the isotactic polypropylene comprises a homopolymer formed by the polymerisation of propylene by Ziegler-Natta catalysis. The isotactic polypropylene typically has a weight average molecular weight Mw of from 100,000 to 4,000,000 and a number average molecular weight Mn of from 40,000 to 100,000, with a melting point of from about 159 to 169° C. However, the polypropylene fibres produced in accordance with this specification suffer from the technical problem that the isotactic polypropylene, being made using a Ziegler-Natta catalyst, does not have particularly high mechanical properties, particularly tenacity.

WO-A-96/23095 discloses a method for providing a non-woven fabric with a wide bonding window in which the non-woven fabric is formed from fibres of a thermoplastic polymer blend including from 0.5 to 25 wt % of syndiotactic polypropylene. The syndiotactic polypropylene may be blended with a variety of different polymers, including isotactic polypropylene. The specification includes a number of examples in which various mixtures of syndiotactic polypropylene with isotactic polypropylene were produced. The isotactic polypropylene comprised commercially available isotactic polypropylene, which is produced using a Ziegler-Natta catalyst. It is disclosed in the specification that the use of syndiotactic polypropylene widens the window of temperature over which thermal bonding can occur, and lowers the acceptable bonding temperature.

WO-A-96/23095 also discloses the production of fibres from blends including syndiotactic polypropylene which are either bi-component fibres or bi-constituent fibres. Bi-component fibres are fibres which have been produced from at least two polymers extruded from separate extruders and spun together to form one fibre. Bi-constituent fibres are produced from at least two polymers extruded from the same extruder as a blend. Both bi-component and bi-constituent fibres are disclosed as being used to improve the thermal bonding of Ziegler-Natta polypropylene in non-woven fabrics. In particular, a polymer with a lower melting point compared to the Ziegler-Natta isotactic polypropylene, for example polyethylene, random copolymers or terpolymers, is used as the outer part of the bi-component fibre or blended in the Ziegler-Natta polypropylene to form the bi-constituent fibre.

EP-A-0634505 discloses improved propylene polymer yarn and articles made therefrom in which for providing yarn capable of increased shrinkage syndiotactic polypropylene is blended with isotactic polypropylene with there being from 5 to 50 parts per weight of syndiotactic polypropylene. It is disclosed that the yarn has increased resiliency and shrinkage, particularly useful in pile fabric and carpeting. It is disclosed that the polypropylene blends display a lowering of the heat softening temperature and a broadening of the thermal response curve as measured by differential scanning calorimetry as a consequence of the presence of syndiotactic polypropylene.

U.S. Pat. No. 5,269,807 discloses a suture fabricated from syndiotactic polypropylene exhibiting a greater flexibility than a comparable suture manufactured from isotactic polypropylene. The syndiotactic polypropylene may be blended with, inter alia, isotactic polypropylene.

EP-A-0451743 discloses a method for moulding syndiotactic polypropylene in which the syndiotactic polypropylene may be blended with a small amount of a polypropylene having a substantially isotactic structure. It is disclosed that fibres may be formed from the polypropylene. It is also disclosed that the isotactic polypropylene is manufactured by the use of a catalyst comprising titanium trichloride and an organoaluminium compound, or titanium trichloride or titanium tetrachloride supported on magnesium halide and an organoaluminium compound, i.e. a Ziegler-Natta catalyst.

EP-A-0414047 discloses polypropylene fibres formed of blends of syndiotactic and isotactic polypropylene. The blend includes at least 50 parts by weight of the syndiotactic polypropylene and at most 50 parts by weight of the isotactic polypropylene. It is disclosed that the extrudability of the fibres is improved and the fibre stretching conditions are broadened.

It is further known to produce syndiotactic polypropylene using metallocene catalysts as has been disclosed for example in aforementioned U.S. Pat. No. 5,269,807.

Recently, metallocene catalysts have also been employed to produce isotactic polypropylene. Isotactic polypropylene which has been produced using a metallocene catalyst is identified hereinafter as miPP. Fibres made of miPP exhibit much higher mechanical properties, mainly tenacity, than typical Ziegler-Natta polypropylene based fibres, hereinafter referred to as ZNPP fibres. However, this gain in tenacity is only partly transferred to non-woven fabrics which have been produced from the miPP fibres by thermal bonding. Indeed, fibres produced using miPP have a very narrow thermal bonding window, the window defining a range of thermal bonding temperatures through which, after thermal bonding of the fibres, the non-woven fabric exhibits the best mechanical properties. As a result, only a small number of the miPP fibres contribute to the mechanical properties of the non-woven fabric. Also, the quality of the thermal bond between adjacent miPP fibres is poor. Thus known miPP fibres have been found to be more difficult to thermally bond than ZNPP fibres, despite a lower melting point.

WO-A-97/10300 discloses polypropylene blend compositions wherein the blend may comprise from 25% to 75% by weight metallocene isotactic polypropylene and from 75 to 25% by weight Ziegler-Natta isotactic polypropylene copolymer. The specification is fundamentally directed to the production of films from such polypropylene blends.

U.S. Pat. No. 5,483,002 discloses propylene polymers having low-temperature impact strength containing a blend of one semi-crystalline propylene homopolymer with either a second semi-crystalline propylene homopolymer or a non-crystallising propylene homopolymer.

EP-A-0538749 discloses a propylene copolymer composition for production of films. The composition comprises a blend of two components, the first component comprising either a propylene homopolymer or a copolymer of propylene with ethylene or another alpha-olefin having a carbon number of 4 to 20 and the second component comprising a copolymer of propylene with ethylene and/or an alpha-olefin having a carbon number of 4 to 20.

It is an aim of the present invention to broaden the thermal bonding window of miPP fibres. It is a further aim of the invention to provide non-woven fabrics of miPP fibres exhibiting improved mechanical properties, in particular tenacity.

It is known that polypropylene fibres, and non-woven fabrics made of polypropylene fibres, tend to feel rough to the touch. It is also an aim of the present invention to improve the softness of miPP polypropylene fibres.

The present invention provides a polypropylene fibre including at least 80% by weight of a first isotactic polypropylene produced by a metallocene catalyst, and from 5 to 20 by weight of a second isotactic polypropylene produced by a Ziegler-Natta catalyst.

The polymeric fibre may preferably include from 85 to 95% by weight of the first isotactic polypropylene and from 5 to 15% by weight of the second isotactic polypropylene.

The polypropylene fibre may generally include from 0 to 15% by weight, more preferably from 0 to 10% by weight, of a syndiotactic polypropylene (sPP). The addition of sPP can improve the softness of the fibres as well as the thermal bonding.

The second polypropylene produced by the Ziegler-Natta catalyst (ZNPP) may be a homopolymer, copolymer or terpolymer or a physical or chemical blend of such polymers.

The first polypropylene produced by the metallocene catalyst (miPP) is a homopolymer, copolymer, being either a random or block copolymer, or terpolymer of isotactic polypropylene produced by a metallocene catalyst or physical or chemical blend of such metallocene polymers.

Preferably, the first polypropylene has a dispersion index (D) of from 1.8 to 4. Preferably, the first polypropylene has a melting temperature in the range of from 130 to 161° C. for homopolymer and a melting temperature of from 80 to 160° C. for a copolymer or terpolymer.

The miPP preferably has a melt flow index (MFI) of from 1 to 2500 g/10 mins. In this specification the MFI values are those determined using the procedure of ISC 1133 using a load of 2.16 kg a temperature of 230° C.

More preferably, the first polypropylene homopolymer has an Mn of from 30,000 to 130,000 kDa and the MFI may range from 5 to 90 g/10 min for spunlaid or staple fibres.

Preferably, the second polypropylene has a dispersion index (D) of from 3 to 12. Preferably, the second polypropylene has a melting temperature in the range of from 80 to 169° C., more preferably a melting temperature of from 158 to 169° C. for homopolymer and a melting temperature of from 100 to 160° C. for a copolymer or terpolymer. A typical melting temperature for homo ZNPP is 162° C.

The ZNPP preferably has a melt flow index (MFI) of from 1 to 100 g/10 mins.

More preferably, the second polypropylene homopolymer or copolymer has a MFI may ranging from 15 to 60 g/10 min for spunlaid or 10 to 30 g/10 min for staple fibres.

The sPP is preferably a homopolymer or a random copolymer having a RRRR racemic pentad content of at least 70%. The sPP may alternatively be a block copolymer having a higher comonomer content, or a terpolymer. Preferably, the sPP has a melting temperature of up to about 130° C. The sPP typically has two melting peaks, one being around 112° C. and the other being around 128° C. The sPP typically has an MFI of from 0.1 to 1000 g/10 min, more typically from 1 to 60 g/10 min. The sPP may have a monomodal or multimodal molecular weight distribution, and most preferably is a bimodal polymer in order to improve the processability of the sPP.

The present invention further provides a fabric produced from the polypropylene fibre of the invention.

The present invention yet further provides a product including that fabric, the product being selected from among others a filter, personal wipe, diaper, feminine hygiene product, incontinence product, wound dressing, bandage, surgical gown, surgical drape and protective cover.

The present invention is predicated on the discovery by the present inventor that when blended with a major amount of miPP, even in small concentrations, ZNPP causes improved thermal bonding of the miPP even when the ZNPP is having a higher melting point than that of the miPP. Accordingly, when blending homopolymer miPP, which has a typical melting range of from about 130° C. to about 161° C., with homopolymer ZNPP, which typically has a melting range of from about 159° C. to about 169° C., fibres containing substantially high concentration of miPP exhibit superior thermal bonding properties.

The present invention will now be described by way of example only with reference to the accompanying drawings, in which.

It is known in the art that fibres with good thermal bonding properties have a relatively large elongation at break and show a plateau region in the stress-elongation curve obtained by tensile tests.

Figure 1:
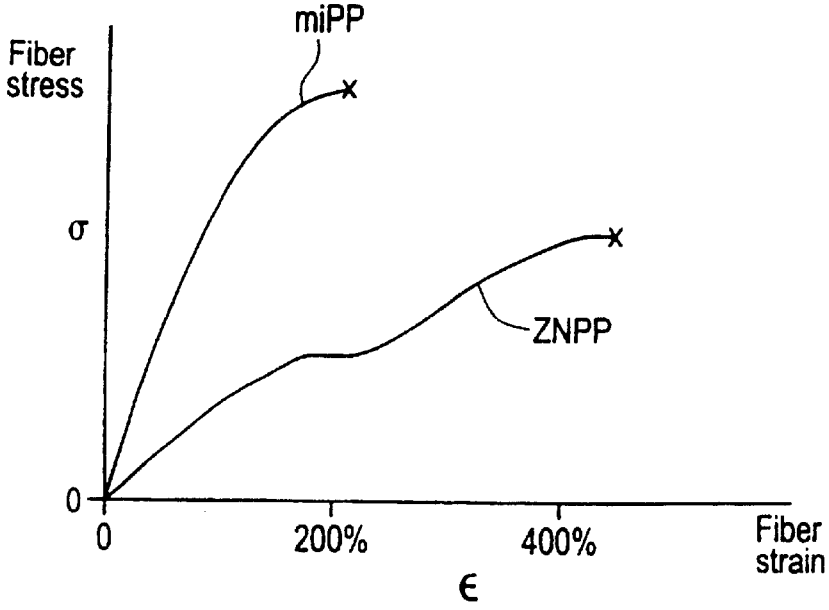
FIG. 1 is a stress/strain graph showing the relationship between stress and strain for a typical miPP and a typical ZNPP.

Referring to FIG. 1, it may be seen for a typical miPP, when formed into fibres the miPP has a high tenacity and therefore a high Young's modulus (represented by the relatively steep slope of the stress/strain plot for miPP), and a relatively low elongation at break, typically around 200%. In contrast, for ZNPP, this exhibits a higher elongation at break, typically greater than 400% and a lower Young's modulus, manifested by a relatively shallow slope in the stress/strain graph. Furthermore, at a strain of around 200% the ZNPP typically exhibits a plateau in the stress/strain graph. The higher fibre tenacity obtained with miPP results from the molecular orientation of a miPP developed during spinning. It is very likely that the presence of ZNPP in miPP impedes development of that molecular orientation even at concentrations around or below 20% wt. As a consequence, the mechanical properties of miPP fibres are very similar to those of ZNPP fibres even if miPP is the main component of the blend or ZNPP concentration ranging from 20 to 50 wt % of ZNPP. As concentration of Znpp decreases below 20 wt % some molecular orientation typical of miPP can progressively develop in the fibre during spinning. Accordingly, the fibre tenacity progressively increases and elongation at break progressively decreases when ZNPP concentration decreases.

Figure 2:
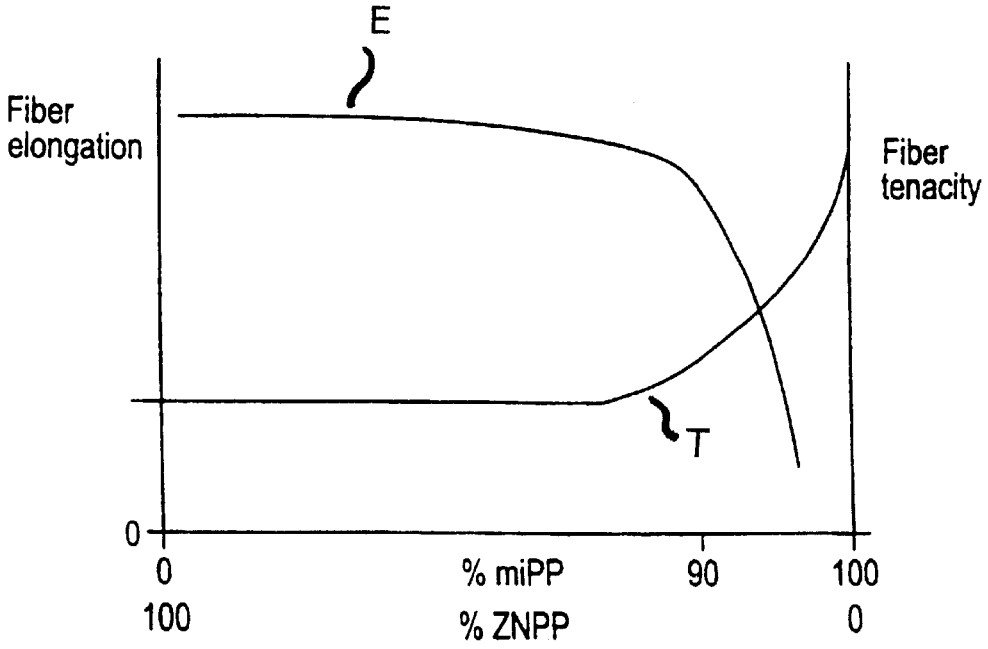
FIG. 2 is a graph showing the relationship between tenacity and composition for an miPP/ZNPP blend.

Referring to FIG. 2, this shows the relationship between tenacity T and fiber elongation E and composition for an miPP/ZNPP blend in a polypropylene fibre. It may be seen that for amounts of miPP of less than about 60 to 80% miPP in the blend, the mechanical properties of the blend with respect to tenacity are similar to that for ZNPP. At greater than about 90% miPP in the blend, the tenacity is greatly improved, but this is offset by reduced elongation at break and as a consequence, tendency to have good thermal bonding so that the high tenacity of fibre is not realised in the resultant non-woven fabric. Accordingly, to achieve good mechanical properties in a non-woven fabric, typically the miPP/ZNPP blend includes from 5 to 20 wt % ZNPP.

An industrial thermal bonding process for producing a non-woven fabric employs the passage at high speed of a layer of fibres to be thermally bonded through a pair of heated rollers. This process thus requires rapid and uniform melting of the surfaces of adjacent fibres in order for a strong and reliable thermal bond to be achieved without destroying the molecular orientation developed in the core of the fibre. The addition of ZNPP to the miPP despite not lowering the thermal bonding temperature of the fibres so as to broaden the thermal bonding temperature range or "window" for the fibres, nevertheless increases the ease of thermal bonding the fibres together. Thus the incorporation of ZNPP into miPP enables the maximum strength of the non-woven fabric to be greatly increased as a result of this increased thermal bond formation between adjacent fibres.

The miPP employed in accordance with the invention has a narrow molecular weight distribution, typically having a dispersion index D of from 1.8 to 4, more preferably from 1.8 to 3. The dispersion index D is the ratio Mw/Mn, where Mw is the weight number average molecular weight and Mn is the number average molecular weight of the polymer. The miPP has a melting temperature in the range of from 130° C. to 161° C. The properties of two typical miPP resins or use in the invention are specified in Table 1.

The addition of sPP to the miPP also has been found by the inventor to improve the softness of the fibres. As a result of a surface rejection phenomenon, the inventor has found that the softness of the fibres may be increased using only small amounts of sPP, for example from 0.3 wt % sPP in the sPP/miPP/ZNPP blend. Since the blending of sPP into miPP permits a lower thermal bonding temperature to be employed than would be employed for pure miPP fibres, and since lower thermal bonding temperatures tend to reduce the roughness to the touch of a non-woven fabric produced from the fibres, introducing sPP in accordance with the invention into miPP improves the softness of the non-woven fabric. The composition of a typical sPP for use in the invention is specified in Table 1.

Furthermore, when sPP is incorporated into miPP to form blends thereof, and when those blends are used to produce spun fibres, the sPP promotes fibres having improved natural bulk, resulting in improved softness of the non-woven fabric.

In addition, the use of miPP in blends with ZNPP and optionally sPP in accordance with the invention tends to provide fibres which can be more readily spun as compared to known ZNPP fibres. Indeed, the substantial reduction of such long chains in the molecular weight distribution of the miPP compared to standard ZNPP tends to reduce built-in stress during spinning thereby to allow in an increase in the maximum spin speed for the fibres of the miPP/ZNPP blends in accordance with the invention.

The incorporation of sPP into the miPP of this invention to form blends thereof provides a broader thermal bonding window, allowing transfer of the properties of the miPP fibres into the properties of the non-woven fabrics produced from the blends. The thermal bonding temperature of fibres produced from such blends is also slightly lower. The fibres and non-woven fabrics produced from the blends have increased softness and the spun fibres have natural bulk as a result of the introduction of sPP into the miPP of this invention. The fibres also have improved resiliency compared to known polypropylene ZNPP fibres as a result of the use of sPP. Furthermore, one use of miPP allows the production of finer fibres, resulting in softer fibres and a more homogenous distribution of the fibres in the non-woven fabric.

Although it was known prior to the present invention to use a second polymer in fibres, it has not heretofore been proposed to employ ZNPP in a blend with miPP for the production of fibres. Efficient thermal bonding of the fibres is required to transfer the outstanding mechanical properties of miPP fibres into non-woven fabrics. In addition, only around 5 weight percent of ZNPP is enough to observe a significant improvement in thermal bondability of the fibres and mechanical properties of the non-woven fabrics. As a consequence, the spinnability of the fibres produced using miPP/ZNPP blends in accordance with the invention is not significantly modified as compared to known miPP fibres.

The fibres produced in accordance with the invention may be either bi-component fibres or bi-constituent fibres. For bi-component fibres, miPP and ZNPP are fed into two different extruders. Thereafter the two extrudates are spun together to form single fibres. For the bi-constituent fibres, blends of miPP/ZNPP are obtained by: dry blending pellets, flakes or fluff of the two polymers before feeding them into a common extruder; or using pellets or flakes of a blend of miPP and ZNPP which have been extruded together and then re-extruding the blend from a second extruder.

When the blends of ZNPP/miPP are used to produce fibres in accordance with the invention, it is possible to adapt the temperature profile of the spinning process to optimise the processing temperature yet retaining the same throughput as with pure miPP. For the production of spunlaid fibres, a typical extrusion temperature would be in the range of from 200° C. to 260° C., most typically from 230° C. to 250° C. For the production of staple fibres, a typical extrusion temperature would be in the range of from 230° C. to 330° C., most typically from 280° C. to 310° C.

The fibres produced in accordance with the invention may be produced from miPP/ZNPP blends having other additives to improve the mechanical processing or spinnability of the fibres. The fibres produced in accordance with the invention may be used to produce non-woven fabrics for use in filtration; in personal care products such as wipers, diapers, feminine hygiene products and incontinence products; in medical products such as wound dressings, surgical gowns, bandages and surgical drapes; in protective covers; in outdoor fabrics and in geotextiles. Non-woven fabrics made with the ZNPP/miPP fibres of the invention can be part of such products, or constitute entirely the products. As well as making non-woven fabrics, the fibres may also be employed to make a knitted fabric or a mat. The non-woven fabrics produced from the fibres in accordance with the invention can be produced by several processes, such as air through blowing, melt blowing, spun bonding or bonded carded processes. The fibres of the invention may also be formed as a non-woven spunlace product which is formed without thermal bonding by fibres being entangled together to form a fabric by the application of a high pressure-fluid such as air or water.

The present invention will now be described in greater detail by reference to the following non-limiting examples.

EXAMPLE 1

In accordance with this example, the properties of a non-woven product composed of polypropylene fibres incorporating at least 80 wt % miPP with the remainder being znPP were compared to fibres composed of pure miPP. Thus the pure miPP had an MFI of 32 g/10 mins and a Mw/Mn ratio of 3. The znPP had an MFI of 12 g/10 mins and an Mw/Mn ratio of 7. Three blends, hereinafter called Poly 1, 2 and 3, of the miPP and the znPP with respective weight ratios of 80 wt % miPP/20 wt % znPP, 90 wt % miPP/10 wt % znPP and 95 wt % miPP/5 wt % znPP were produced. Fibres were made both of the blends Poly 1, 2 and 3 and of the pure miPP. The fibres were spun by a long spin process, with the polymer temperature in the spinnerets being 280° C. The fibre titre after spinning was 2.3 dtex and the fibre titre after drawing was 2.1 dtex. The fibres were texturised and cut after the drawing step. They were then stored in bales of 400 kg for 10 days. The fibres were then subjected to carding and bonding at a speed of 110 m/minute. Thereafter, non-woven products having a weight of 20 g/m$^2$ were produced by thermal bonding. The thermal bonding temperature and the mechanical properties of the non-wovens thereby produced for the Poly 1, 2 and 3 and the pure miPP are shown in Table 2.

It may be seen from Table 2 that the mechanical properties of the non-woven thermally bonded product of Poly 1, 2 and 3 are greater than that for pure miPP at corresponding thermal bonding temperatures.

EXAMPLE 2

In accordance with this example, various blends of znPP and miPP were made and the compositions of the blends are specified in Table 3.

The miPP had an MFI of 13 g/10 min. The znPP was the same as that employed in Example 1. The blends were prepared by dry blending pellets of the components and pouring the dry blend into the feeder of the extruder immediately after blending. Fibres were then produced from the extruded blend. The fibre was produced using a spinneret having 224 holes with a length/diameter ratio of 8/0.8. The extrusion temperature was 285° C. with quenching air at 15° C. at a pressure of 50 Pa. The temperature of the drawing godets was 80° C. For each blend, fibres were produced under the conditions of take-up at 1600 m/min followed by drawing with a draw ratio (SR) of 1.3. The throughput per hole was adjusted to keep the fibre titre at around 2.5 dtex.

Figure 3:
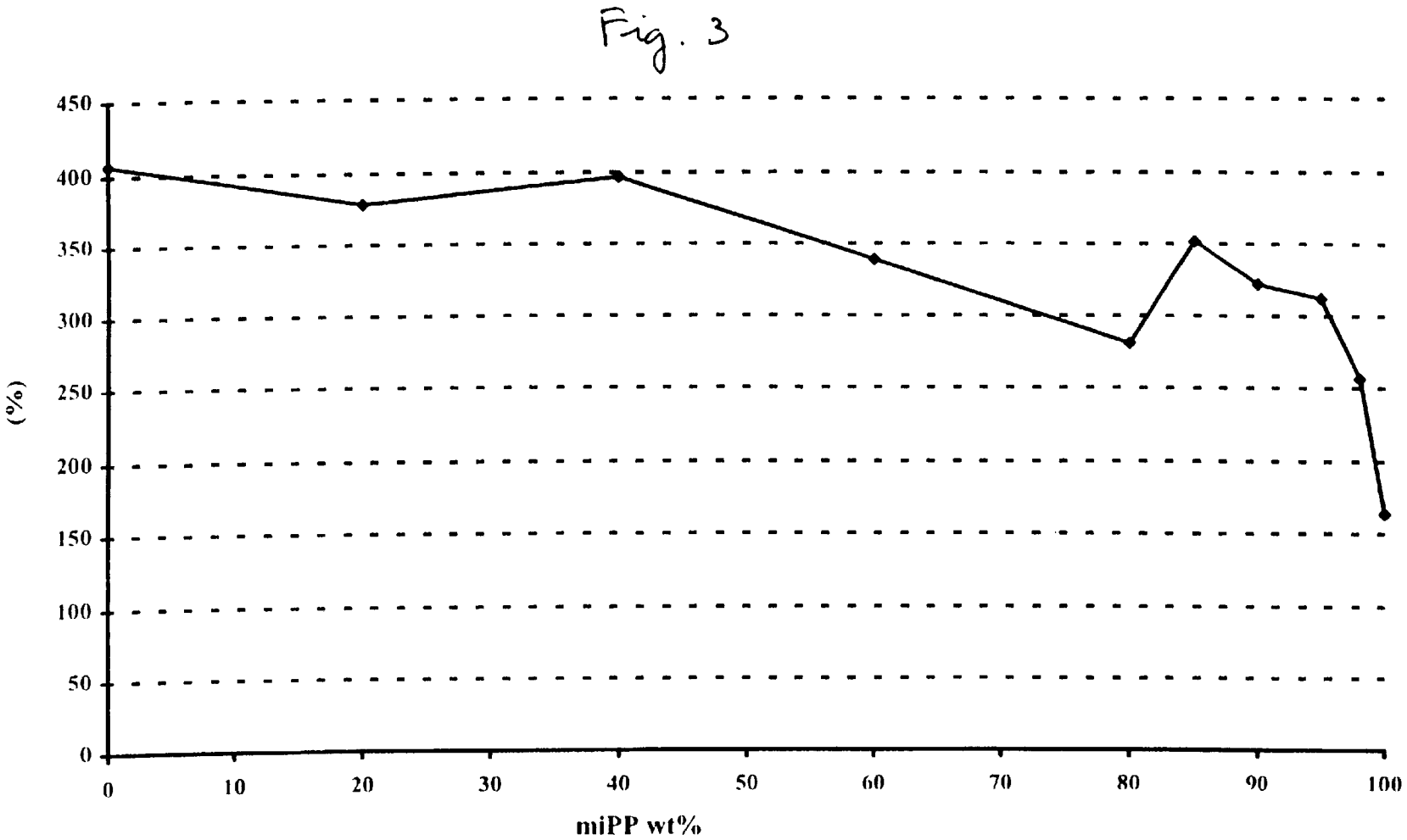
FIGS. 3 and 4 are graphs showing the relationship between, respectively, elongation (%) at maximum drawing force and fibre tenacity (cN/tex) at maximum drawing force with respect to miPP amount for fibres produced from blends of miPP and znPP.
Figure 4:
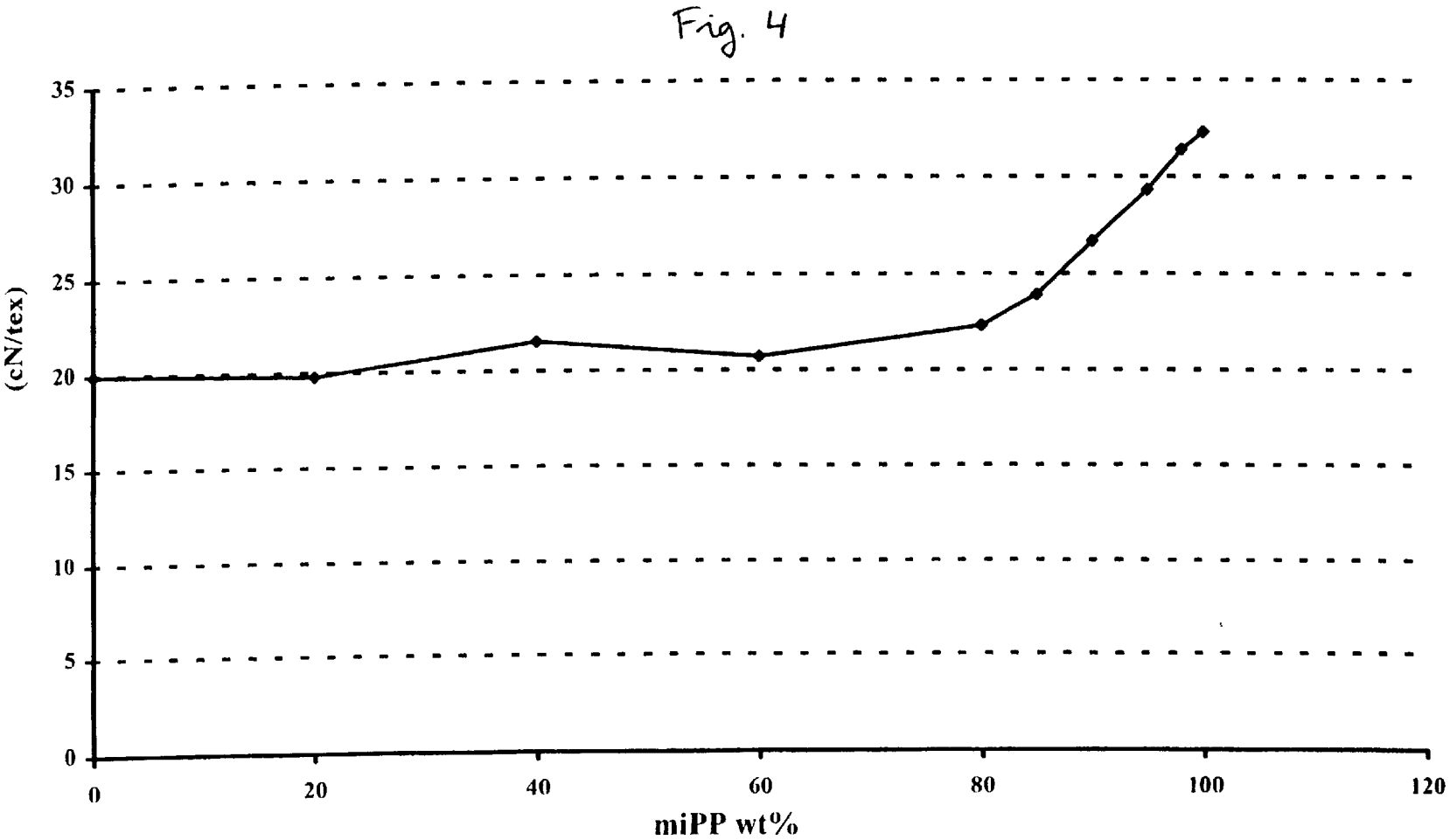

Table 3 shows the titre, the fibre tenacity at 10% elongation, the elongation at maximum drawing force, the fibre tenacity at maximum drawing force (sigma@max). FIGS. 3 and 4 are graphs showing the relationship between the elongation at maximum drawing force and the fibre tenacity at maximum drawing force, respectively, with respect to the amount of miPP in the blend.

Table 4 shows the titre, the fibre tenacity at 10% elongation, the elongation at maximum drawing force, the fibre tenacity at maximum drawing force (sigma@max) for fibres produced as described here-above but without drawing.

It may be noted that for a blend having greater than 80 wt % miPP in the blend of znPP/miPP, the elongation at maximum drawing force and the fibre tenacity at maximum drawing force are substantially increased with respect to lower miPP amounts. Thus by adding miPP to a znPP/miPP blend in an amount of at least 80 wt % miPP, the mechanical characteristics of the fibre are improved, in particular the fibre elongation and tenacity, and in addition, as shown in Example 1, the characteristics of the bonding of the fibres to form thermally bonded non-wovens are improved.

EXAMPLE 3

This example demonstrates the increase in bulk or softness of polypropylene fibres by incorporating into the blend of znPP/miPP an amount of sPP.

When polypropylene fibres are laid on a flat surface, such as a glass plate, the morphology of the fibre, in particular its degree of straightness or, conversely, its degree of waviness, is an indication of the bulk of the fibre. The fibre, which can be examined by optical microscopy, can be seen to have a wavy or substantially sinusoidal morphology, with increased waviness (i.e. a reduced pitch between peaks of adjacent waves) corresponding to increased bulk or softness of the fibre.

When sPP was added to a polypropylene homopolymer in an amount up to 15 wt %, it has been found that the distance between two peaks of the wavy surface decreases, in turn meaning that the bulk or softness of the fibres increases. For example when 5 wt % sPP was blended into a Ziegler-Natta polypropylene homopolymer, the distance between the peaks was 5.1 mm whereas when 15 wt % sPP was blended into the same polypropylene, the distance between the peaks was around 4 mm. This demonstrates that the bulk or softness of the fibres was increased with increasing amount of sPP in the base polypropylene.

TABLE 1

| | | ZNPP | sPP | miPP1 | miPP2 |
|---|---|---|---|---|---|
| $MI_2$ | | 14 | 3.6 | 32 | 13 |
| Tm | ° C. | 162 | 110 and 127 | 148.7 | 151 |
| Mn | kDa | 41983 | 37426 | 54776 | 85947 |
| Mw | kDa | 259895 | 160229 | 137423 | 179524 |
| Mz | kDa | 1173716 | 460875 | 242959 | 321119 |
| Mp | kDa | 107648 | 50516 | 118926 | 150440 |
| D | | 6.1 | 4.3 | 2.5 | 2.1 |

TABLE 2

| Blend | Thermal Bonding Temperature (° C.) | Max Force Mach. Dir (N/5 cm) | Elong @ break Mach. dir (%) | Max Force Trans dir (N/5 cm) | Elong @ break Trans dir (%) |
|---|---|---|---|---|---|
| Poly 1 | 142 | 36 | 95 | 10 | 105 |
| Poly 1 | 148 | 28 | 62 | 14 | 133 |
| Poly 2 | 142 | 32 | 90 | 11 | 105 |
| Poly 2 | 148 | 28 | 50 | 12 | 117 |
| Poly 3 | 142 | 29 | 50 | 10 | 80 |
| Poly 3 | 148 | 26 | 40 | 11 | 40 |
| Pure miPP | 142 | 13 | 25 | 6 | 20 |
| Pure miPP | 148 | 12 | 20 | 6 | 20 |

TABLE 3

| | | Take-up: 1600 m/min followed by drawing (SR = 1.3) | | | |
|---|---|---|---|---|---|
| wt % znPP | wt % miPP | Titre (dtex) | Tenacity @ 10% (cN/tex) | Elong @ max (%) | Sigma @ max (cN/tex) |
| 100 | 0 | 2.6 | 9.6 | 407 | 20.0 |
| 80 | 20 | 2.6 | 9.2 | 379 | 19.8 |
| 60 | 40 | 2.6 | 9.2 | 397 | 21.5 |
| 40 | 60 | 2.6 | 8.9 | 339 | 20.7 |
| 20 | 80 | 2.6 | 8.8 | 281 | 22.3 |
| 15 | 85 | 2.5 | 7.8 | 352 | 23.9 |
| 10 | 90 | 2.5 | 8.2 | 322 | 26.7 |
| 5 | 95 | 2.5 | 8.6 | 312 | 29.3 |
| 2 | 98 | 2.5 | 9.2 | 256 | 31.4 |
| 0 | 100 | 2.6 | 11.5 | 164 | 32.3 |

TABLE 4

| | | Direct Take-up: 1600 m/min | | | |
|---|---|---|---|---|---|
| wt % znPP | wt % miPP | Titre (dtex) | Tenacity @ 10% (cN/tex) | Elong @ max (%) | Sigma @ max (cN/tex) |
| 100 | 0 | 2.6 | 6.8 | 435 | 14.8 |
| 80 | 20 | 2.6 | 6.5 | 513 | 15.9 |
| 60 | 40 | 2.5 | 6.6 | 456 | 16.4 |
| 40 | 60 | 2.6 | 6.3 | 461 | 17.1 |
| 20 | 80 | 2.6 | 6.1 | 443 | 20.3 |
| 15 | 85 | 2.2 | 5.8 | 485 | 18.9 |
| 10 | 90 | 2.4 | 5.8 | 424 | 20.4 |
| 5 | 95 | 2.6 | 5.4 | 496 | 20.5 |
| 2 | 98 | 2.6 | 5.5 | 363 | 24.0 |
| 0 | 100 | 2.6 | 6.2 | 285 | 27.9 |

What is claimed is:

1. A polypropylene fibre including at least 80% by weight of a first isotactic polypropylene produced by a metallocene catalyst, and from 5 to 20% by weight of a second isotactic polypropylene produced by a Ziegler-Natta catalyst.

2. A polypropylene fibre according to claim 1 including from 90 to 95% by weight of the first isotactic polypropylene and from 5 to 10% by weight of the second isotactic polypropylene.

3. A polypropylene fibre according to claim 1 wherein the first polypropylene is a homopolymer, copolymer or terpolymer of isotactic polypropylene or a blend of such polymers.

4. A polypropylene fibre according to claim 3 wherein the first polypropylene has a dispersion index (D) of from 1.8 to 4.

5. A polypropylene fibre according to claim 3 wherein the first polypropylene has a melting temperature in the range of from 80 to 161° C.

6. A polypropylene fibre according to claim 1 wherein the first polypropylene has a melt flow index (MFI) of from 1 to 2500 g/10 mins.

7. A polypropylene fibre according to claim 6 wherein the second polypropylene has a dispersion index of from 3 to 12.

8. A polypropylene fibre according to claim 1 wherein the second polypropylene has a melting temperature in the range of from 80 to 169° C.

9. A polypropylene fibre according to claim 1 further comprising up to 15% by weight of a syndiotactic polypropylene (sPP).

10. A polypropylene fibre according to claim 9 comprising up to 10% by weight of a syndiotactic polypropylene (sPP).

11. A polypropylene fibre according to claim 10 wherein the sPP is a homopolymer, a random copolymer, a block copolymer or a terpolymer or a blend of such polymers.

12. A polypropylene fibre according to claim 10 wherein the sPP has a melting temperature of up to about 130° C.

13. A fabric produced from the polypropylene fibre according to claim 1.

14. A product including a fabric according to claim 13, the product being selected from a filter, personal wipe, diaper, feminine hygiene product, incontinence product, wound dressing, bandage, surgical gown, surgical drape, geotextile, outdoor fabric and protective cover.

* * * * *